US007596495B2

(12) United States Patent
Kazama et al.

(10) Patent No.: US 7,596,495 B2
(45) Date of Patent: Sep. 29, 2009

(54) CURRENT NOISE SPECTRUM ESTIMATION METHOD AND APPARATUS WITH CORRELATION BETWEEN PREVIOUS NOISE AND CURRENT NOISE SIGNAL

(75) Inventors: Michiko Kazama, Tokyo (JP); Mikio Tohyama, Tokyo (JP); Toru Hirai, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 543 days.

(21) Appl. No.: 11/093,672

(22) Filed: Mar. 29, 2005

(65) Prior Publication Data

US 2005/0256705 A1 Nov. 17, 2005

(30) Foreign Application Priority Data

Mar. 30, 2004 (JP) ..... 2004-100935

(51) Int. Cl.
*G10L 21/02* (2006.01)
*G10L 19/02* (2006.01)

(52) U.S. Cl. ..... 704/226; 704/237

(58) Field of Classification Search ..... 704/226, 704/237

See application file for complete search history.

(56) References Cited

U.S. PATENT DOCUMENTS 5,706,394 A * 1/1998 Wynn ..... 704/219
6,205,421 B1 3/2001 Morii

FOREIGN PATENT DOCUMENTS

| | | | |
|---|---|---|---|
| JP | 9-034497 A | | 2/1997 |
| JP | 11-003094 | | 1/1999 |
| JP | 2002-014694 | | 1/2002 |
| JP | 2003-223186 | | 8/2003 |
| WO | WO 01/31640 | * | 5/2001 |

OTHER PUBLICATIONS

Notice of Reason for Rejection mailed May 26, 2009, for JP Patent Application No. 2004-100935, with English Translation, 6 pages.

* cited by examiner

*Primary Examiner*—David R Hudspeth
*Assistant Examiner*—Abdelali Serrou
(74) *Attorney, Agent, or Firm*—Morrison & Foerster LLP

(57) ABSTRACT

A method is provided for recurrently estimating a spectrum of noise at each signal observation interval from a sound signal which contains the noise and which is observed at each signal observation interval. In the method, there are acquired an envelope of a previous spectrum of the noise which has been previously estimated from the sound signal observed at a previous signal observation interval, and an envelope of a current spectrum of the sound signal which is observed at a current signal observation interval subsequent to the previous signal observation interval. Then, a value of correlation is computed between the envelop of the previous spectrum of the noise and the envelope of the current spectrum of the sound signal. A current spectrum of the noise contained in the sound signal observed at the current signal observation interval is estimated in accordance with the computed value of the correlation and based on the previous spectrum of the noise and the current spectrum of the sound signal.

14 Claims, 5 Drawing Sheets

$\ell=2$

CURRENT NOISE SPECTRUM ESTIMATION METHOD AND APPARATUS WITH CORRELATION BETWEEN PREVIOUS NOISE AND CURRENT NOISE SIGNAL

BACKGROUND OF THE INVENTION

1. Technical Field

The present invention relates to a method of estimating a spectrum of noise from a sound signal mixed with the noise. Also, the present invention relates to a method and an apparatus for generating sound signals with the above-mentioned noise being suppressed on the basis of the above-mentioned estimation.

2. Related Art

Techniques for estimating, from a sound signal mixed with noise, the spectrum of this noise are used to suppress the noise (namely, noise is removed from a noise-mixed sound signal to take out a target sound signal) in voice recognition technologies and voice communication technologies such as telephony. Technologies for suppressing noise contained in sound signals include a spectral subtraction method for example. In this spectral subtraction method, the spectrum of noise is estimated from a noise-mixed sound signal and the estimated noise spectrum is subtracted from the spectrum of the noise-mixed sound signal, thereby attaining noise suppression.

The related-art technologies based on the spectral subtraction method are disclosed in the following patent documents:

[Patent document 1] Japanese Unexamined Patent Application No. Hei 11-3094

[Patent document 2] Japanese Unexamined Patent Application No. 2002-14694

[Patent document 3] Japanese Unexamined Patent Application No. 2003-223186

SUMMARY OF THE INVENTION

The present invention is intended to provide a novel method of estimating a spectrum of noise from noise-mixed sound signals. The present invention is also intended to provide a method and an apparatus for generating sound signals with noise being suppressed on the basis of the above-mentioned noise suppression.

In carrying out the invention and according to one aspect thereof, there is provided a method of recurrently estimating a spectrum of noise at each signal observation interval from a sound signal which contains the noise and which is observed at each signal observation interval. The inventive method comprises the steps of: acquiring an envelope of a previous spectrum of the noise which has been previously estimated from the sound signal observed at a previous signal observation interval; acquiring an envelope of a current spectrum of the sound signal which is observed at a current signal observation interval subsequent to the previous signal observation interval; computing a value of correlation between the envelop of the previous spectrum of the noise and the envelope of the current spectrum of the sound signal; and estimating a current spectrum of the noise contained in the sound signal observed at the current signal observation interval in accordance with the computed value of the correlation and based on the previous spectrum of the noise and the current spectrum of the sound signal.

Practically in the above-mentioned noise spectrum estimation method, the estimating step estimates the current spectrum of the noise by mixing the previous spectrum of the noise and the current spectrum of the sound signal at a mix ratio determined according to the computed value of the correlation. Specifically, the estimating step determines the mix ratio according to the computed value of the correlation such that a portion of the current spectrum of the sound signal increases and a portion of the previous spectrum of the noise decreases as the value of the correlation increases, while a portion of the current spectrum of the sound signal decreases and a portion of the previous spectrum of the noise increases as the value of the correlation decreases. Further, the estimating step determines the mix ratio according to the computed value of the correlation such that a variation of the mix ratio per a unit value of the correlation is increased as the computed value of the correlation increases.

Preferably, in the above-mentioned noise spectrum estimation method, the estimating step estimates the current spectrum of the noise in terms of a current amplitude spectrum of the noise according to the following equation:

$$|N(k)|=[l-\{\rho^1/(l+\rho^1)\}^m]\cdot|No(k)|+\{\rho^1/(l+\rho^1)\}^m\cdot|X(k)|$$

where |N(k)| denotes the current amplitude spectrum of the noise; |No(k)| denotes a previous amplitude spectrum of the noise; |X(k)| denotes a current amplitude spectrum of the sound signal; ρ denotes the value of the correlation; and l and m denote constants, l being 1 or more, and m being 0 or more.

Further, the estimating step estimates a next spectrum of the noise contained in the sound signal observed at a next signal observation interval subsequent to the current signal observation interval based on the estimated current spectrum of the noise and a next spectrum of the sound signal observed in the next signal observation interval in accordance with a value of the correlation calculated between an envelop of the current spectrum of the noise and an envelope of the next spectrum of the sound signal.

Practically, the acquiring steps acquire the envelope of the previous spectrum of the noise in the form of an envelope of a previous amplitude spectrum of the noise, and acquire the envelope of the current spectrum of the sound signal in the form of an envelope of a current amplitude spectrum of the sound signal.

In another aspect of the invention, there is provided a method of recurrently estimating an amplitude spectrum of noise at each signal observation interval from an input sound signal which contains the noise and which is observed at each signal observation interval, and processing the input sound signal by the estimated amplitude spectrum of the noise to produce an output sound signal while suppressing the noise. The inventive method comprises the steps of: acquiring an envelope of a previous amplitude spectrum of the noise which has been previously estimated from the input sound signal observed at a previous signal observation interval; fourier-transforming the input sound signal which is observed at a current signal observation interval subsequent to the previous signal observation interval to provide a current amplitude spectrum of the input sound signal and a current phase spectrum of the input sound signal; acquiring an envelope of the current amplitude spectrum of the input sound signal; computing a value of correlation between the envelop of the previous amplitude spectrum of the noise and the envelope of the current amplitude spectrum of the input sound signal; estimating a current amplitude spectrum of the noise contained in the input sound signal observed at the current signal observation interval in accordance with the computed value of the correlation and based on the previous amplitude spectrum of the noise and the current amplitude spectrum of the input sound signal; subtracting the estimated current amplitude spectrum of the noise from the current amplitude spectrum of the input sound signal to provide a current amplitude spectrum of the output sound signal; recombining the current amplitude spectrum of the output sound signal and the current phase spectrum of the input sound signal to compose a current spectrum of the output sound signal; and inverse-fourier-transforming the composed current spectrum to produce the output sound signal which is at least partly free of the noise contained in the input sound signal.

Practically, the estimating step estimates a next amplitude spectrum of the noise contained in the input sound signal observed at a next signal observation interval subsequent to the current signal observation interval based on the estimated current amplitude spectrum of the noise and a next amplitude spectrum of the input sound signal observed at the next signal observation interval in accordance with a value of the correlation calculated between an envelop of the current amplitude spectrum of the noise and an envelope of the next amplitude spectrum of the input sound signal.

In a further aspect of the invention, there is provided an apparatus for recurrently estimating a spectrum of noise at each signal observation interval from a sound signal which contains the noise and which is observed at each signal observation interval. The inventive apparatus comprises: a storing section that stores a previous amplitude spectrum of the noise which has been previously estimated from the sound signal observed at a previous signal observation interval; a fourier-transforming section that fourier-transforms the sound signal which is observed at a current signal observation interval subsequent to the previous signal observation interval to provide a current amplitude spectrum of the sound signal and a current phase spectrum of the sound signal; an extracting section that extracts an envelope of the current amplitude spectrum of the sound signal, and extracts an envelope of the previous amplitude spectrum of the noise; a computing section that computes a value of correlation between the envelop of the previous amplitude spectrum of the noise and the envelope of the current amplitude spectrum of the sound signal; and an estimating section that estimates a current amplitude spectrum of the noise contained in the sound signal observed at the current signal observation interval in accordance with the computed value of the correlation and based on the previous amplitude spectrum of the noise and the current amplitude spectrum of the sound signal, wherein the estimated current amplitude spectrum of the noise is stored in the storing section to replace the previous amplitude spectrum of the noise.

Preferably, the storing section stores the current amplitude spectrum of the sound signal for use in estimating of a next amplitude spectrum of the noise contained in the sound signal observed from a next signal observation interval subsequent to the current signal observation interval.

Preferably, the inventive apparatus further comprises an initialization section that operates when the estimating of the spectrum of the noise is started for loading an initial amplitude spectrum into the storing section so that the loaded initial amplitude spectrum is used as first one of the previous amplitude spectrum of the noise.

In a further aspect of the invention, there is provided an apparatus for recurrently estimating an amplitude spectrum of noise at each signal observation interval from an input sound signal which contains the noise and which is observed at each signal observation interval, and for processing the input sound signal by the estimated amplitude spectrum of the noise to produce an output sound signal while suppressing the noise. The inventive apparatus comprises: a storing section that stores a previous amplitude spectrum of the noise which has been previously estimated from the input sound signal observed at a previous signal observation interval; a fourier-transforming section that fourier-transforms the input sound signal which is observed at a current signal observation interval subsequent to the previous signal observation interval to provide a current amplitude spectrum of the input sound signal and a current phase spectrum of the input sound signal; an extracting section that extracts an envelope of the current amplitude spectrum of the input sound signal, and extracts an envelope of the previous amplitude spectrum of the noise; a computing section that computes a value of correlation between the envelop of the previous amplitude spectrum of the noise and the envelope of the current amplitude spectrum of the input sound signal; an estimating section that estimates a current amplitude spectrum of the noise contained in the input sound signal observed at the current signal observation interval in accordance with the computed value of the correlation and based on the previous amplitude spectrum of the noise and the current amplitude spectrum of the input sound signal, wherein the estimated current amplitude spectrum of the noise is stored in the storing section in place of the previous amplitude spectrum of the noise; a subtracting section that subtracts the estimated current amplitude spectrum of the noise from the current amplitude spectrum of the input sound signal to provide a current amplitude spectrum of the output sound signal; a recombining section that recombines the current amplitude spectrum of the output sound signal and the current phase spectrum of the input sound signal to compose a current spectrum of the output sound signal; and an inverse-fourier-transforming section that inverse-fourier-transforms the composed current spectrum to produce the output sound signal which is at least partly free of the noise contained in the input sound signal.

Practically, the storing section stores the current amplitude spectrum of the input sound signal for use in estimating of a next amplitude spectrum of the noise contained in the input sound signal observed from a next signal observation interval subsequent to the current signal observation interval.

In a further aspect of the invention, there is provided a program for use in an apparatus having a processor for recurrently estimating a spectrum of noise at each signal observation interval from a sound signal which contains the noise and which is observed at each signal observation interval. The inventive program is executable by the processor for causing the apparatus to perform a method comprising the steps of: acquiring an envelope of a previous spectrum of the noise which has been previously estimated from the sound signal observed at a previous signal observation interval; acquiring an envelope of a current spectrum of the sound signal which is observed at a current signal observation interval subsequent to the previous signal observation interval; computing a value of correlation between the envelop of the previous spectrum of the noise and the envelope of the current spectrum of the sound signal; and estimating a current spectrum of the noise contained in the sound signal observed at the current signal observation interval in accordance with the computed value of the correlation and based on the previous spectrum of the noise and the current spectrum of the sound signal.

In a further aspect of the invention, there is provided a program for use in an apparatus having a processor for recurrently estimating an amplitude spectrum of noise at each signal observation interval from an input sound signal which contains the noise and which is observed at each signal observation interval, and for processing the input sound signal by the estimated amplitude spectrum of the noise to produce an output sound signal while suppressing the noise. The inventive program is executable by the processor for causing the apparatus to perform a method comprising the steps of: acquiring an envelope of a previous amplitude spectrum of the noise which has been previously estimated from the input sound signal observed at a previous signal observation interval; fourier-transforming the input sound signal which is observed at a current signal observation interval subsequent to the previous signal observation interval to provide a current amplitude spectrum of the input sound signal and a current phase spectrum of the input sound signal; acquiring an envelope of the current amplitude spectrum of the input sound signal; computing a value of correlation between the envelop of the previous amplitude spectrum of the noise and the envelope of the current amplitude spectrum of the input sound signal; estimating a current amplitude spectrum of the noise contained in the input sound signal observed at the current signal observation interval in accordance with the computed value of the correlation and based on the previous amplitude spectrum of the noise and the current amplitude spectrum of the input sound signal; subtracting the estimated current amplitude spectrum of the noise from the current amplitude spectrum of the input sound signal to provide a current amplitude spectrum of the output sound signal; recombining the current amplitude spectrum of the output sound signal and the current phase spectrum of the input sound signal to compose a current spectrum of the output sound signal; and inverse-fourier-transforming the composed current spectrum to produce the output sound signal which is at least partly free of the noise contained in the input sound signal.

A noise spectrum estimation method according to the invention is able to estimate a spectrum of noise of a signal under observation in a currently observed signal interval. A noise suppression method and a noise suppression apparatus according to the invention are able to remove noise from sound signals by use of the noise spectrum estimation method according to the invention, thereby obtaining pure sound signals.

DETAILED DESCRIPTION OF THE INVENTION

Embodiment 1

Figure 1:
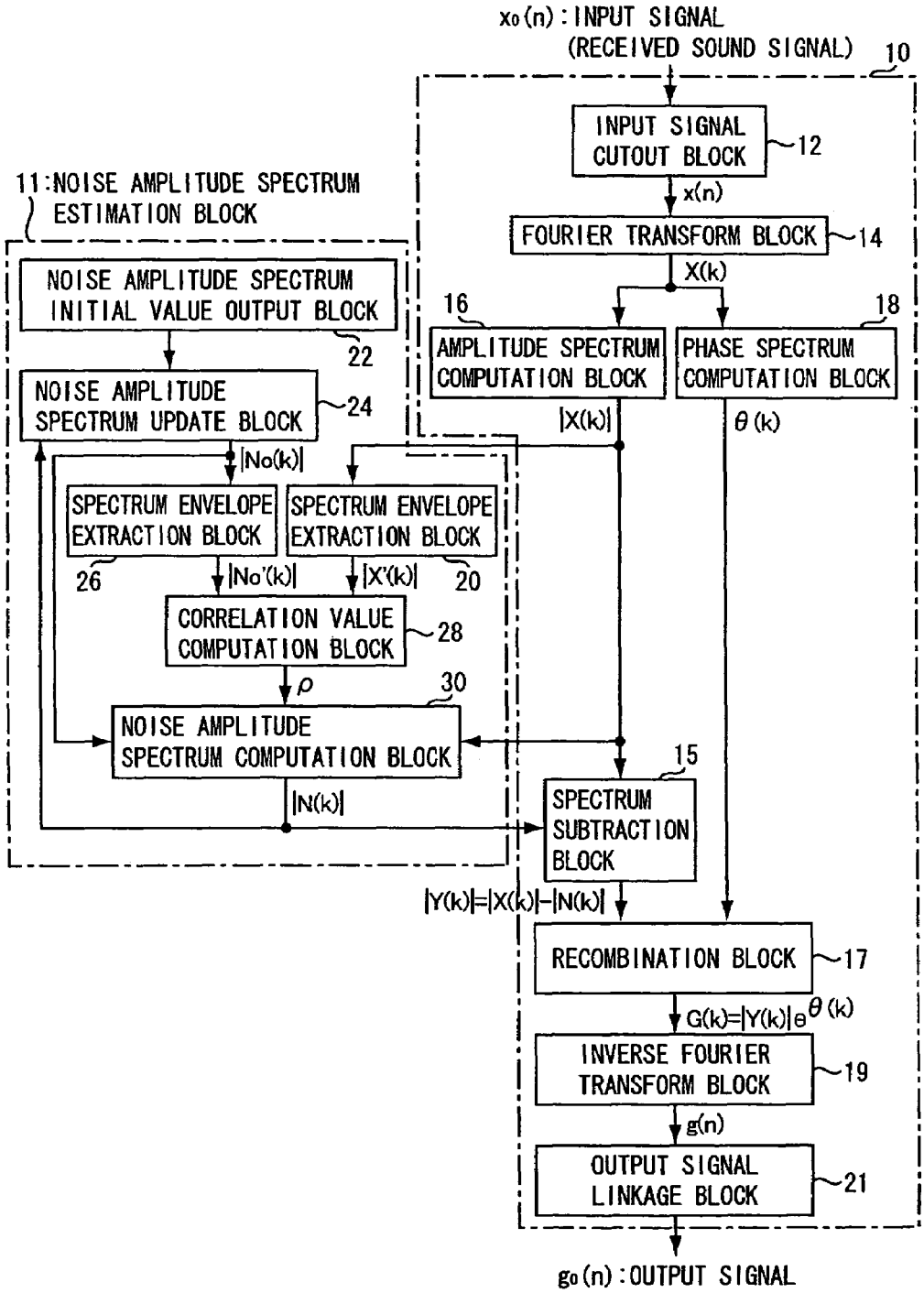
FIG. 1 is a block diagram illustrating a noise suppression apparatus practiced as one embodiment of the invention.

The following describes an embodiment of the invention in which a noise spectrum estimation method according to the invention is applied to noise suppression processing based on the spectral subtraction method. Referring to FIG. 1, there is shown a block diagram illustrating an exemplary configuration of a noise suppression apparatus practiced as one embodiment of the invention. A section enclosed by dash-and-dot lines 10 is common to a noise suppression apparatus based on a related-art spectral subtraction method.

Figure 2:
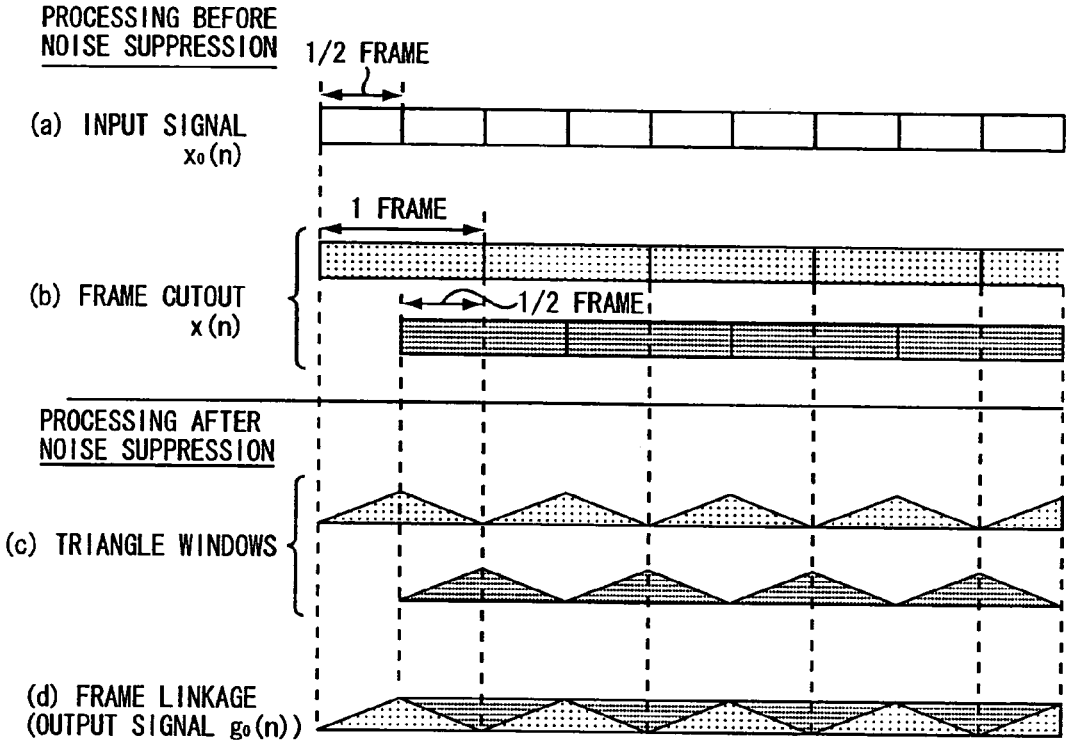
FIG. 2 is a timing chart indicative of input signal cutout process and output signal linkage process in the noise suppression apparatus shown in FIG. 1.

A section enclosed by dash-and-dot lines 11 is a noise amplitude spectrum estimation block for estimating an amplitude spectrum of noise by the novel method proposed herein. Input signal (or an observation signal) xo(n) (n=0, 1, 2, . . . , N-1, where N denotes the number of samples of one frame) is a sample sequence of a sound signal including noise inputted through a microphone for example (this sound signal is a signal inputted for voice recognition or a sound signal received by telephone communication, for example). Input signal xo(n) is mixed with regular noise such as background noise. Input signal xo(n) is inputted in an input signal cutout block and is cut out into frames each consisting of a predetermined number of samples. In order not to cause a discontinuation between frames in finally synthesizing an output signal after noise suppression processing, frame cutout is executed by sequentially shifting by half a frame as shown in FIGS. 2 (*a*) and (*b*). It should be noted that it is preferable in sound quality to make one frame length N about 125 to 500 ms. This one frame length is equivalent to 1024 to 4096 samples if the sampling frequency of input signal xo(n) is about 8 kHz.

Input signal x(n) cut out by the input signal cutout block 12 is sequentially Fourier-transformed by a Fourier transform block 14, frame by frame. Discrete Fourier transform X(k) (k-0, 1, 2, . . . , N-1) sequentially obtained by this Fourier transform is inputted in an amplitude spectrum computation block 16 and a phase spectrum computation block 18. The amplitude spectrum computation block 16 obtains amplitude spectrum |X(k)| of discrete Fourier transform X(k) from equation (1) below:

$$|X(k)|=\{XR(k)^2+XI(k)^2\}^{1/2} \tag{1}$$

where XR(k) is the real part of X(k) and XI is the imaginary part of X(k).

The phase spectrum computation block 18 obtains phase spectrum θ(k) of discrete Fourier transform X(k) from equation (2) below:

$$\theta(k)=\tan^{-1}\{XI(k)/XR(k)\} \tag{2}$$

In accordance with obtained amplitude spectrum |X(k)|, a noise amplitude spectrum estimation block 11 estimates amplitude spectrum (or noise amplitude spectrum) |N(k)| included in input signal x(n) by means of a technique to be described later. A spectrum subtraction block 15 subtracts noise amplitude spectrum |N(k)| of a current frame obtained by the noise amplitude spectrum estimation block 11 from amplitude spectrum |X(k)| of current frame obtained by the amplitude spectrum computation block 16 from equation (3) below for each of the cutout frames, thereby obtaining amplitude spectrum |Y(k)| of current frame with noise amplitude spectrum removed:

$$|Y(k)|=|X(k)|-|N(k)| \tag{3}$$

A recombination block 17 recombines amplitude spectrum |Y(k)| of current frame obtained by the spectrum subtraction block 15 with phase spectrum θ(k) of input signal x(n) of current frame obtained by the phase spectrum computation block 18 to get complex spectrum data G(k) shown in equation (4) below:

$$G(k)=|Y(k)|e^{\theta(k)} \tag{4}$$

An inverse Fourier transform block 19 inverse-Fourier-transforms complex spectrum data G(k) into time waveform data (g). An output signal linkage block 21 puts a triangle window shown in FIG. 2(*c*) (namely, imparting a gain having characteristic in which the gain linearly goes up from 0 to 1 in the first ½ frame of one-frame length and goes down from 1 to 0 in the last ½ frame) over time waveform data g(n) of one-frame length obtained every half a frame (namely, obtained by overlapping by half a frame) and additionally links time waveform data g(n) attached with triangle windows as shown in FIG. 2(*d*), thereby generating output signal go(n). Thus, output signal go(n) (the target signal) with noise removed from input signal xo(n) is obtained. It should be noted that triangle window is used as a window function in the above-mentioned processing; it is also practicable to use another window function, such as Hanning window, Hamming window, or trapezoidal window.

The following describes the noise amplitude spectrum estimation block 11 shown in FIG. 1. A spectrum envelope extraction block 20 removes fine irregularity characteristic included in amplitude spectrum |X(k)| to extract envelope |X'(k)| of amplitude spectrum |X(k)| (namely, smoothes amplitude spectrum |X(k)|. This is because, if amplitude spectrum |X(k)| itself is used in the correlation value computation to be described later, the correlation value of the spectrum goes low to blur the distinction between "audio interval" and "noise interval". Namely, noise, as considered in terms of long time average, its spectrum is expected to have a smooth distribution that is approximately uniform over a wide band. However, as considered in terms of short time, noise has a spectrum variation having many irregularities. On the other hand, unlike noise, the overall frequency characteristic of a sound signal has a large amplitude value for a particular frequency band and therefore is not distributed uniformly over the entire frequency band. Because the method of estimating noise spectrum in the present embodiment is characterized that distinction between "noise distributed uniformly over the entire frequency band" and "audio having a large amplitude value fro a particular frequency band" by the magnitude of spectrum correlation value, the fine irregularity characteristic of the amplitude spectrum of noise is removed.

The spectrum envelope extraction block 20 executes lowpass filter processing by regarding amplitude spectrum |X(k)| as a time wave for example (amplitude spectrum |X(k)| is directly lowpass-filtered or moving-averaged in frequency axis direction), thereby extracting the envelope. A too high or too low cutoff frequency of the lowpass filter for directly lowpass filtering amplitude spectrum |X(k)| cannot extract audio characteristic. Namely, if the cutoff frequency is too high, the fine irregularities of noise spectrum cannot be removed. If the cutoff frequency is too low, the audio component itself is removed. Experimentally, the audio characteristic could be obtained with good result when the cutoff frequency of the lowpass filter was set in a range of fs/300 Hz (equivalent to about 50 Hz if regarded as fs=16 kHz sampled time sequence, fs being the sampling frequency of input signal x(n)) to fs/16 Hz (equivalent to the about 1000 Hz if regarded as fs=16 kHz sampled time sequence). To be more specific, if the cutoff frequency of the lowpass filter is set to fs/300 Hz, the eighth-order Butterworth lowpass filter with its cutoff frequency equivalent to 50 Hz may be used.

It should be noted that a method of obtaining an cepstrum by Fourier-transforming amplitude spectrum |X(k)| is also available for extracting the envelope of amplitude spectrum |X(k)| by the spectrum envelope extraction block 20. In this method, the spectrum envelope is extracted by applying a window function that transmits only the low quefrency of cepstrum by a method explained in "Digital Signal Processing, Institute of Electronics, Information And Communication Engineering of Japan (Corona Publishing), 3.3.5 Cepstrum (pp. 66 through 70)" and "Introduction to Digital Signal Processing, Keinchi Maruyama (Maruzen), 8.3 Computation of Cepstrum" for example, to be specific.

A noise amplitude spectrum initial value output block 22 outputs the initial value of noise amplitude spectrum. Namely, at the activation of the present apparatus, the noise amplitude spectrum data to be referenced is not available, so that an initial value must be set. Following methods are possible for setting the initial value.

Method 1: data consisting of only the background noise containing no audio inputted upon activation of the apparatus is Fourier-transformed and, from the resultant data, amplitude spectrum data computed from equation (1) above is obtained and set as a noise amplitude spectrum initial value.

Method 2: the amplitude spectrum data equivalent to background noise is stored in memory in advance and this data is read at activation of the apparatus to be set as a noise amplitude spectrum initial value. Alternatively, the envelope data of the amplitude spectrum data equivalent to background noise is stored in memory in advance and this data is read at activation of the apparatus to be set as an initial value of noise amplitude spectrum envelope data.

Method 3: the amplitude spectrum data of white noise and pink noise is set as a noise amplitude spectrum initial value.

A noise amplitude spectrum update block 24 sequentially captures and stores noise amplitude spectrum |N(k)| obtained very half frame by a noise amplitude spectrum computation block 30 to be described later, delays the amplitude spectrum by a half frame, and sequentially outputs the delayed amplitude spectrum as noise amplitude spectrum estimated value |No(k)| obtained for the observation signal in the signal interval observed last (a half frame before). At the activation of the apparatus, noise amplitude spectrum |N(k)| has not yet been estimated, so that the noise amplitude spectrum update block 24 outputs the initial value of noise amplitude spectrum set by the noise amplitude spectrum initial value output block 22. A spectrum envelope extraction block 26 extracts envelope |No'(k)| of noise amplitude spectrum |No(k)| in the same manner as by the spectrum envelope extraction block 20.

A correlation value computation block 28 obtains a correlation value (or correlation coefficient) ρ between amplitude spectrum envelope |X'(k)| of current frame extracted by the spectrum envelope extraction block 20 and noise amplitude spectrum envelope |No'(k)| extracted by the spectrum envelope extraction block 26.

Here, let input signal amplitude spectrum envelope be |X'(k)|=(x1, x2, . . . , Xk) and noise amplitude spectrum envelope be |No'(k)|=(y1, y2, . . . , yk), then correlation value ρ is obtained from equation (5) below.

$$\rho = \frac{C_{XY}}{\sqrt{C_{XX}}\sqrt{C_{YY}}} \text{ where} \tag{5}$$

$$C_{XY} = \sum_{k=1}^{i}\left[\left(x_k - \left(\sum_{k=1}^{i} x_k\right)\Big/ i\right)\left(y_k - \left(\sum_{k=1}^{i} y_k\right)\Big/ i\right)\right]$$

$$C_{XX} = \sum_{k=1}^{i}\left(x_k - \left(\sum_{k=1}^{i} x_k\right)\Big/ i\right)^2$$

$$C_{YY} = \sum_{k=1}^{i}\left(y_k - \left(\sum_{k=1}^{i} y_k\right)\Big/ i\right)^2$$

$i$ denotes number of elements of vector $|X'(k)|$, $|N_0'(k)|$

The noise amplitude spectrum computation block 30 obtains noise amplitude spectrum |N(k)| about the currently observed sound signal in the signal interval in accordance with obtained correlation value ρ from equation (6) below.

$$|N(k)=[l-\{\rho^1/(1+\rho^1)\}^m]\cdot|No(k)|+\{\rho^1/(l+\rho^1)\}^m\cdot|X(K)| \tag{6}$$

where |N(k)| denotes the amplitude spectrum of noise estimated for sound signal of frame currently observed;

|No(k)| denotes the amplitude spectrum of noise estimated for sound signal of frame observed last (a half frame before);

|X(k)| denotes the spectrum of sound signal of frame currently observed;

ρ denotes the correlation value between the envelope of the spectrum of sound signal of frame currently observed and the envelope of the spectrum of noise estimated for the sound signal of frame observed last; and l and m denote constants (l being 1 or more, m being 0 or more).

Equation (6) above is used to estimate new amplitude spectrum |N(k)| by adding noise amplitude spectrum |No(k)| estimated last (a half frame before) to input signal amplitude spectrum |X(k)| computed this time with a ratio in accordance with obtained correlation value ρ. Namely, when correlation value ρ is relatively low, it indicates that the audio component contained in the input signal is dominant (providing a voiced interval), so that the ratio of noise amplitude spectrum |No(k)| estimated last is increased and the ratio of amplitude spectrum |X(k)| of the input signal computed this time is decreased. Namely, the ratio control is made in order to prevent noise amplitude spectrum estimated value |N(k)| from being affected by the audio component. In contrast, when correlation value ρ is relatively high, it indicates that the audio component contained in the input signal is not dominant (providing a voiceless interval), so that the ratio of noise amplitude spectrum |No(k)| estimated last is lowered and the ratio of input signal amplitude spectrum |X(k)| computed this time is increased. Namely, this radio control is made in order to cause noise amplitude spectrum estimated value |N(k)| vary by following the slow variation of regular noise. Then, when correlation value ρ is infinitely near 1, noise amplitude spectrum |No(k)| estimated last and input signal amplitude spectrum |X(k)| computed this time are added with the same ratio (0.5 to 0.5). Thus, the amplitude spectrum of noise is updated mainly in the voiceless interval.

Figure 3:
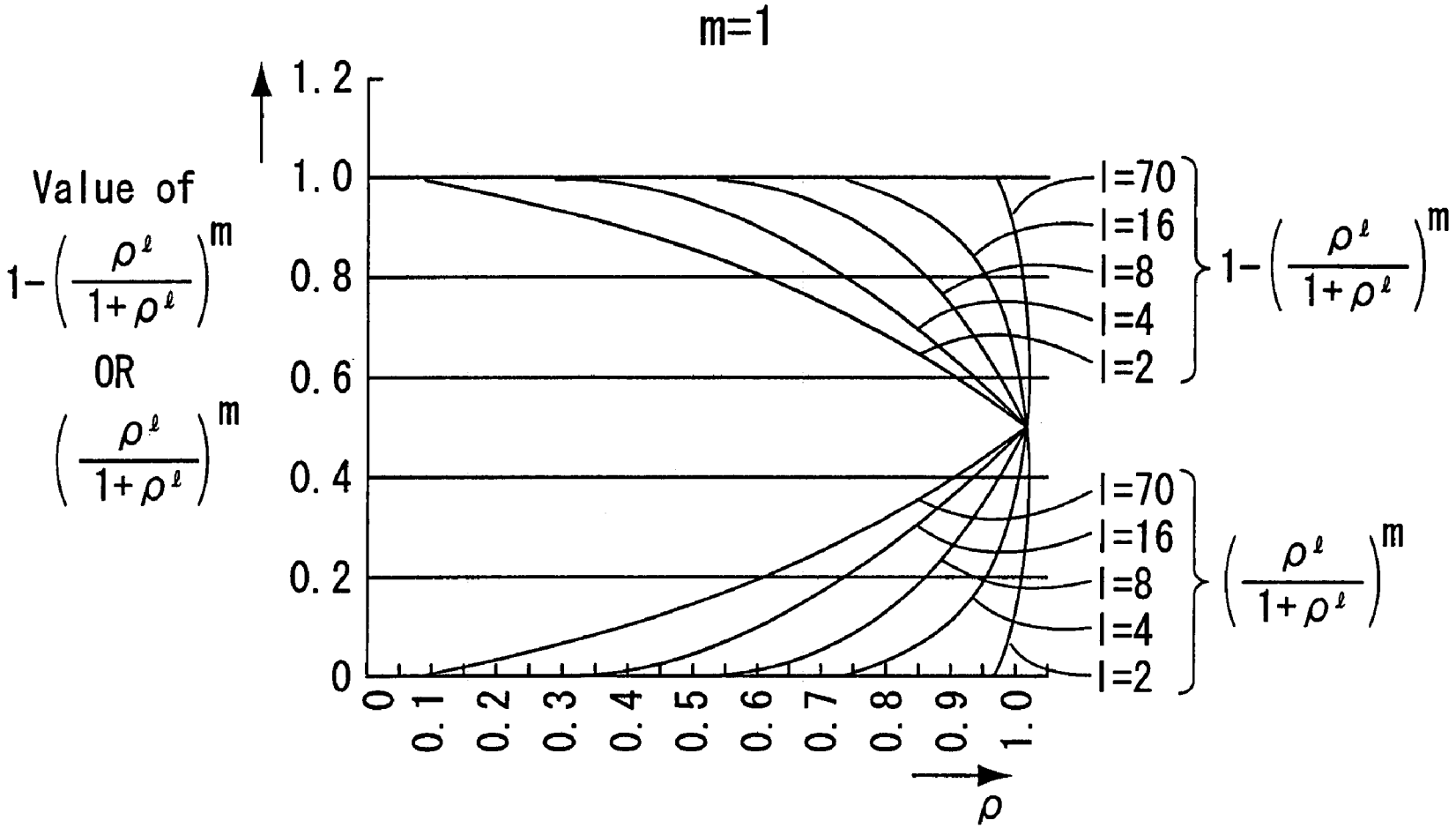
FIG. 3 is a characteristics diagram illustrating a variation in coefficient values $1-\{\rho^1/(1+\rho^1)\}^m$, $\{\rho^1/(1+\rho^1)\}^m$ in equation (6) to correlation value ρ by value l.

In equation (6) above, l represents a constant for the adjustment of the sensitivity to low correlation values. FIG. 3 shows a variation in coefficient values $1-\{\rho^1/(1+\rho^1)\}^m$, $\{\rho^1/(1+\rho^1)\}^m$ in equation (6) to correlation value ρ by value l . It should be noted that, in the example of FIG. 3, m=1. According to FIG. 3, it is known that, as value l increases, an update of the noise amplitude spectrum estimated value at low correlations decreases.

Figure 4:
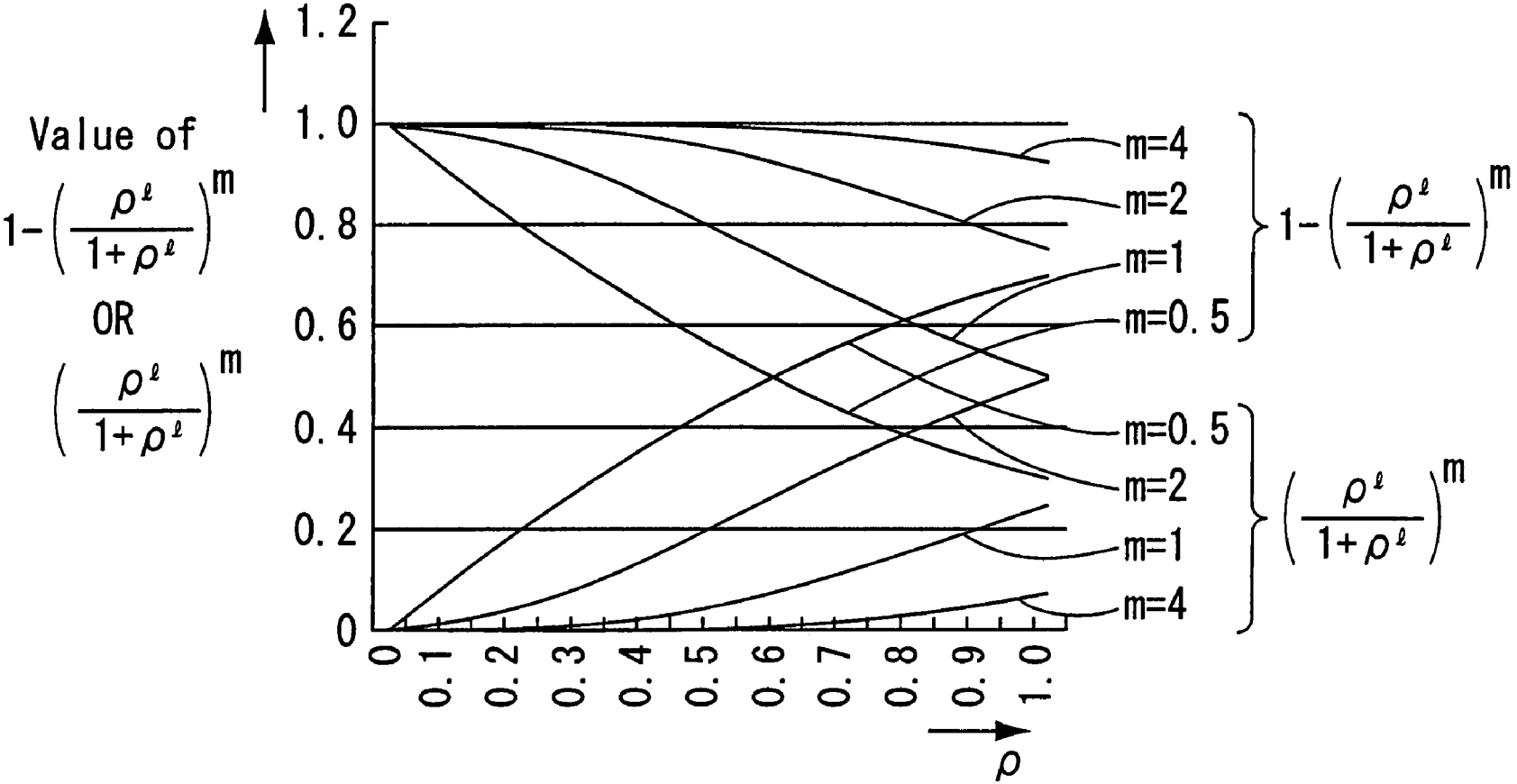
FIG. 4 is a characteristics diagram illustrating a variation in coefficient values $1-\{\rho^1/(1+\rho^1)\}^m$, $\{\rho^1/(1+\rho^1)\}^m$ in equation (6) to correlation value ρ by value m.

In equation (6) above, m represents a constant for the adjustment of an update. FIG. 4 shows a variation in coefficient values $1-\{\rho^1/(1+\rho^1)\}^m$, $\{\rho^1/(1+\rho^1)\}^m$ in equation (6) to correlation value ρ by value m. It should be noted that, in the example of FIG. 4, l=2. According to FIG. 4, it is known that, as value m increases, an update decreases.

Figure 5:
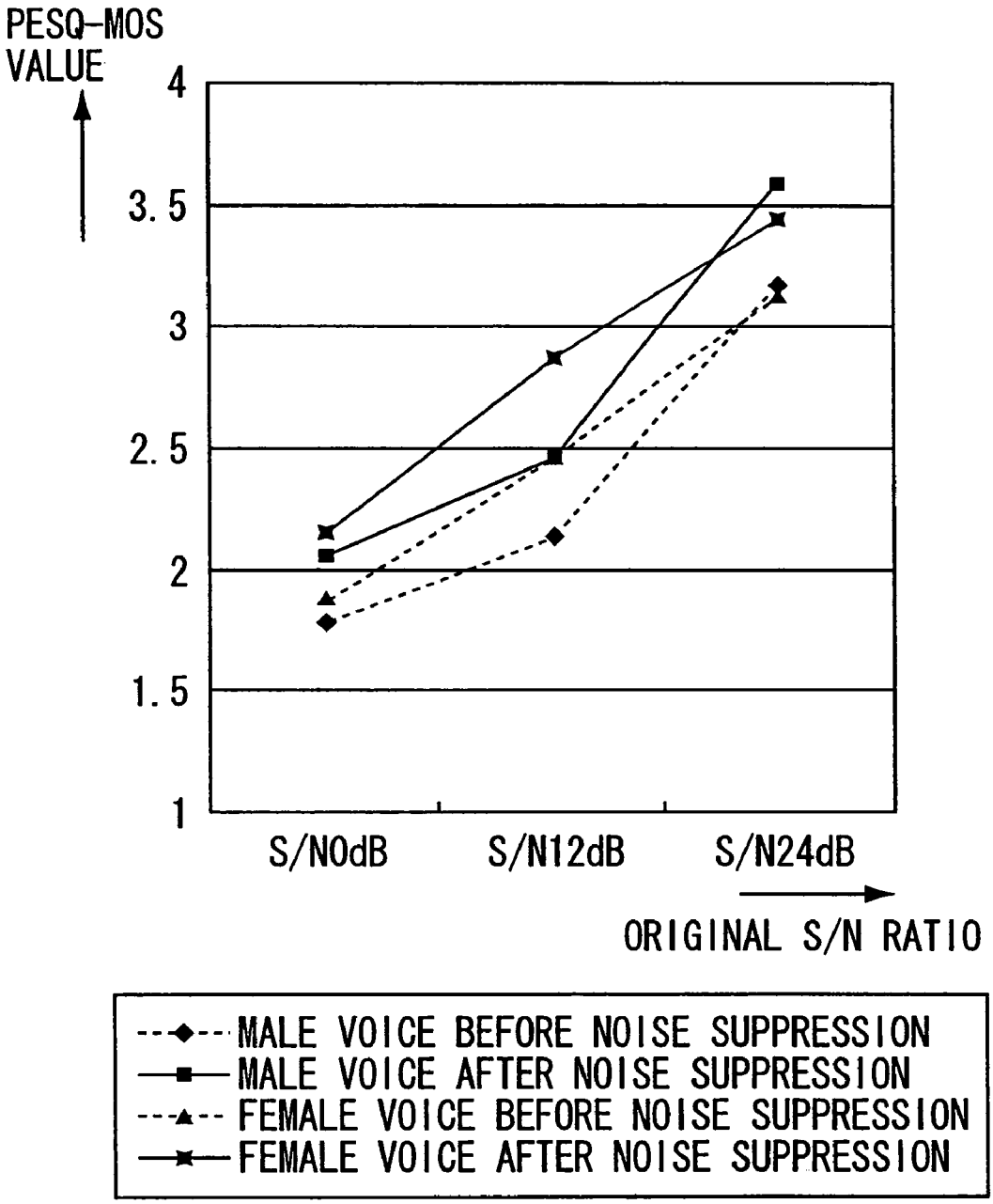
FIG. 5 is a plot diagram illustrating the contents of Table 1 indicative of noise suppression effects brought about by the noise suppression apparatus shown in FIG. 1.

A noise suppression experiment was executed by use of the noise suppression apparatus shown in FIG. 1. In this experiment, PESQ-MOS values were measured in the cases where, in an environment in which noise generated by a projector exists as regular noise, female announce sound and male announce sound are absorbed and the resultant sound absorbed signals are noise-suppressed and not noise-suppressed by the noise suppression apparatus shown in FIG. 1. The processing shown in FIG. 2 (namely, executing frame cutout by shifting by a half frame before noise suppression and additionally combining the frames by applying triangle windows after noise suppression) was executed with the sampling frequency of the sound absorbed signal being 16 kHz and one frame length of frame cutout being 1024 samples. For the computation of noise amplitude spectrum, equation (6) above was used with l value being 70 and m value being 1. It should be noted that PESQ-MOS denotes sound quality evaluation index, ranging from 0.5 to 4.5, the higher PESQ-MOS, the better the sound quality. The measurement results are shown in Table 1. FIG. 5 shows the plots of Table 1.

TABLE 1

| | Female announce + projector noise | | | Male announce + projector noise | | |
|---|---|---|---|---|---|---|
| Original SN ratio | 24 dB | 12 dB | 0 dB | 24 dB | 12 dB | 0 dB |
| PESQ-MOS before noise suppression | 3.13 | 2.49 | 1.89 | 3.18 | 2.16 | 1.79 |
| PESQ-MOS after noise suppression | 3.44 | 2.87 | 2.17 | 3.58 | 2.48 | 2.08 |

Table 1 indicates that higher PESQ-MOS is obtained after the noise suppression executed by the noise suppression apparatus shown in FIG. 1 than before regardless of the levels of background noise (SN ratio 24 dB and SN ratio 12 dB) and the female announce and the male announce.

Variations:

In the above-mentioned embodiment, equation (6) is used for the computation of noise amplitude spectrum. Alternatively, equation (7) below may also be available for the computation of noise amplitude spectrum |N(k)|, for example.

$$|N(k)|=(l-\rho^1)\cdot|No(k)|+\rho^1\cdot|X(k)| \quad (7)$$

If correlation value ρ is below a predetermined value, the ratio of addition of amplitude spectrum |X(k)| of the input signal of frame currently observed can to set to 0 (namely, not to change noise amplitude spectrum estimated value |N(k)|).

In the above-mentioned embodiment, the amplitude spectral subtraction method is used in which noise amplitude spectrum |N(k)| is estimated on the basis of the envelope of input signal amplitude spectrum |X(k)| is estimated and estimated noise amplitude spectrum |N(k)| is subtracted from input signal amplitude spectrum |X(k)|, thereby effecting noise suppression. Alternatively, the power spectral subtraction method may be used in which noise power spectrum $|N(k)|^2$ is estimated on the basis of the envelope of input signal power spectrum $|X(k)|^2$ and estimated noise power spectrum $|N(k)|^2$ is subtracted from input signal power spectrum $|X(k)|^2$, thereby effecting noise suppression. The noise spectrum estimation method according to the invention is applicable to this estimation of noise power spectrum |N(k)|.

In the above-mentioned embodiment, noise amplitude spectrum |N(k)| is estimated on the basis of the envelope of input signal amplitude spectrum |X(k)| and estimated noise amplitude spectrum |N(k)| is subtracted from input signal amplitude spectrum |X(k)|. Alternatively, complex spectrum X(k) itself with input signal amplitude information not separated from phase information may be used, in which noise complex spectrum N(k) is estimated on the basis of the envelope of that complex spectrum X(k) and estimated noise complex spectrum N(k) is subtracted from input signal complex spectrum X(k), thereby effecting noise suppression.

Referring back to FIG. 1, the inventive apparatus is designed for recurrently estimating an amplitude spectrum of noise at each signal observation interval from an input sound signal which contains the noise and which is observed at each signal observation interval, and for processing the input sound signal by the estimated amplitude spectrum of the noise to produce an output sound signal while suppressing the noise. In the inventive apparatus, a storing section (24) stores a previous amplitude spectrum of the noise which has been previously estimated from the input sound signal observed at a previous signal observation interval. A fourier-transforming section (14) fourier-transforms the input sound signal which is observed at a current signal observation interval subsequent to the previous signal observation interval to provide a current amplitude spectrum of the input sound signal and a current phase spectrum of the input sound signal. An extracting section (20 and 26) extracts an envelope of the current amplitude spectrum of the input sound signal, and extracts an envelope of the previous amplitude spectrum of the noise. A computing section (28) computes a value of correlation between the envelop of the previous amplitude spectrum of the noise and the envelope of the current amplitude spectrum of the input sound signal. An estimating section (30) estimates a current amplitude spectrum of the noise contained in the input sound signal observed at the current signal observation interval in accordance with the computed value of the correlation and based on the previous amplitude spectrum of the noise and the current amplitude spectrum of the input sound signal. The estimated current amplitude spectrum of the noise is stored in the storing section (24) in place of the previous amplitude spectrum of the noise. A subtracting section (15) subtracts the estimated current amplitude spectrum of the noise from the current amplitude spectrum of the input sound signal to provide a current amplitude spectrum of the output sound signal. A recombining section (17) recombines the current amplitude spectrum of the output sound signal and the current phase spectrum of the input sound signal to compose a current spectrum of the output sound signal. An inverse-fourier-transforming section (19) inverse-fourier-transforms the composed current spectrum to produce the output sound signal which is at least partly free of the noise contained in the input sound signal.

The above described noise suppression apparatus may have a processor and may be computerized. Namely, a computer program may be provided for use in the noise suppression apparatus having the processor for recurrently estimating an amplitude spectrum of noise at each signal observation interval from an input sound signal which contains the noise and which is observed at each signal observation interval, and for processing the input sound signal by the estimated amplitude spectrum of the noise to produce an output sound signal while suppressing the noise. The computer program is executable by the processor for causing the apparatus to perform the inventive noise estimation and suppression method.

The noise spectrum estimation method according to the invention is also applicable to other fields than noise suppression.

What is claimed is:

1. A method of recurrently estimating a spectrum of noise at each signal observation interval from a sound signal which contains the noise and which is observed at each signal observation interval, the method comprising the steps of:

acquiring an envelope of a previous spectrum of the noise which has been previously estimated from the sound signal observed at a previous signal observation interval;

acquiring an envelope of a current spectrum of the sound signal which is observed at a current signal observation interval subsequent to the previous signal observation interval;

computing a value of correlation between the envelop of the previous spectrum of the noise and the envelope of the current spectrum of the sound signal; and estimating a current spectrum of the noise contained in the sound signal observed at the current signal observation interval in accordance with the computed value of the correlation and based on the previous spectrum of the noise and the current spectrum of the sound signal.

2. The method according to claim 1, wherein the estimating step estimates the current spectrum of the noise by mixing the previous spectrum of the noise and the current spectrum of the sound signal at a mix ratio determined according to the computed value of the correlation.

3. The method according to claim 2, wherein the estimating step determines the mix ratio according to the computed value of the correlation such that a portion of the current spectrum of the sound signal increases and a portion of the previous spectrum of the noise decreases as the value of the correlation increases, while a portion of the current spectrum of the sound signal decreases and a portion of the previous spectrum of the noise increases as the value of the correlation decreases.

4. The method according to claim 2, wherein the estimating step determines the mix ratio according to the computed value of the correlation such that a variation of the mix ratio per a unit value of the correlation is increased as the computed value of the correlation increases.

5. The method according to claim 1, wherein the estimating step estimates the current spectrum of the noise in terms of a current amplitude spectrum of the noise according to the following equation:

$$|N(k)|=[l-\{\rho^1/(1+\rho^1)\}^m]\cdot|No(k)|+\{\rho^1/(l+\rho^1)\}^m\cdot|X(k)|$$

where |N(k)| denotes the current amplitude spectrum of the noise;

|No(k)| denotes a previous amplitude spectrum of the noise;

|X(k)| denotes a current amplitude spectrum of the sound signal;

ρ denotes the value of the correlation; and l and m denote constants, l being 1 or more, and m being 0 or more.

6. The method according to claim 1, wherein the estimating step estimates a next spectrum of the noise contained in the sound signal observed at a next signal observation interval subsequent to the current signal observation interval based on the estimated current spectrum of the noise and a next spectrum of the sound signal observed in the next signal observation interval in accordance with a value of the correlation calculated between an envelop of the current spectrum of the noise and an envelope of the next spectrum of the sound signal.

7. The method according to claim 1, wherein the acquiring steps acquire the envelope of the previous spectrum of the noise in the form of an envelope of a previous amplitude spectrum of the noise, and acquire the envelope of the current spectrum of the sound signal in the form of an envelope of a current amplitude spectrum of the sound signal.

8. A method of recurrently estimating an amplitude spectrum of noise at each signal observation interval from an input sound signal which contains the noise and which is observed at each signal observation interval, and processing the input sound signal by the estimated amplitude spectrum of the noise to produce an output sound signal while suppressing the noise, the method comprising the steps of:

acquiring an envelope of a previous amplitude spectrum of the noise which has been previously estimated from the input sound signal observed at a previous signal observation interval;

fourier-transforming the input sound signal which is observed at a current signal observation interval subsequent to the previous signal observation interval to provide a current amplitude spectrum of the input sound signal and a current phase spectrum of the input sound signal;

acquiring an envelope of the current amplitude spectrum of the input sound signal;

computing a value of correlation between the envelop of the previous amplitude spectrum of the noise and the envelope of the current amplitude spectrum of the input sound signal;

estimating a current amplitude spectrum of the noise contained in the input sound signal observed at the current signal observation interval in accordance with the computed value of the correlation and based on the previous amplitude spectrum of the noise and the current amplitude spectrum of the input sound signal;

subtracting the estimated current amplitude spectrum of the noise from the current amplitude spectrum of the input sound signal to provide a current amplitude spectrum of the output sound signal;

recombining the current amplitude spectrum of the output sound signal and the current phase spectrum of the input sound signal to compose a current spectrum of the output sound signal; and inverse-fourier-transforming the composed current spectrum to produce the output sound signal which is at least partly free of the noise contained in the input sound signal.

9. The method according to claim 8, wherein the estimating step estimates a next amplitude spectrum of the noise contained in the input sound signal observed at a next signal observation interval subsequent to the current signal observation interval based on the estimated current amplitude spectrum of the noise and a next amplitude spectrum of the input sound signal observed at the next signal observation interval in accordance with a value of the correlation calculated between an envelop of the current amplitude spectrum of the noise and an envelope of the next amplitude spectrum of the input sound signal.

10. An apparatus for recurrently estimating a spectrum of noise at each signal observation interval from a sound signal which contains the noise and which is observed at each signal observation interval, the apparatus comprising:

a storing section that stores a previous amplitude spectrum of the noise which has been previously estimated from the sound signal observed at a previous signal observation interval;

a fourier-transforming section that fourier-transforms the sound signal which is observed at a current signal observation interval subsequent to the previous signal observation interval to provide a current amplitude spectrum of the sound signal and a current phase spectrum of the sound signal;

an extracting section that extracts an envelope of the current amplitude spectrum of the sound signal, and extracts an envelope of the previous amplitude spectrum of the noise;

a computing section that computes a value of correlation between the envelop of the previous amplitude spectrum of the noise and the envelope of the current amplitude spectrum of the sound signal; and an estimating section that estimates a current amplitude spectrum of the noise contained in the sound signal observed at the current signal observation interval in accordance with the computed value of the correlation and based on the previous amplitude spectrum of the noise and the current amplitude spectrum of the sound signal, wherein the estimated current amplitude spectrum of the noise is stored in the storing section to replace the previous amplitude spectrum of the noise.

11. The apparatus according to claim 10, wherein the storing section stores the current amplitude spectrum of the sound signal for use in estimating of a next amplitude spectrum of the noise contained in the sound signal observed from a next signal observation interval subsequent to the current signal observation interval.

12. The apparatus according to claim 10, further comprising an initialization section that operates when the estimating of the spectrum of the noise is started for loading an initial amplitude spectrum into the storing section so that the loaded initial amplitude spectrum is used as first one of the previous amplitude spectrum of the noise.

13. An apparatus for recurrently estimating an amplitude spectrum of noise at each signal observation interval from an input sound signal which contains the noise and which is observed at each signal observation interval, and for processing the input sound signal by the estimated amplitude spectrum of the noise to produce an output sound signal while suppressing the noise, the apparatus comprising:

a storing section that stores a previous amplitude spectrum of the noise which has been previously estimated from the input sound signal observed at a previous signal observation interval;

a fourier-transforming section that fourier-transforms the input sound signal which is observed at a current signal observation interval subsequent to the previous signal observation interval to provide a current amplitude spectrum of the input sound signal and a current phase spectrum of the input sound signal;

an extracting section that extracts an envelope of the current amplitude spectrum of the input sound signal, and extracts an envelope of the previous amplitude spectrum of the noise;

a computing section that computes a value of correlation between the envelop of the previous amplitude spectrum of the noise and the envelope of the current amplitude spectrum of the input sound signal;

an estimating section that estimates a current amplitude spectrum of the noise contained in the input sound signal observed at the current signal observation interval in accordance with the computed value of the correlation and based on the previous amplitude spectrum of the noise and the current amplitude spectrum of the input sound signal, wherein the estimated current amplitude spectrum of the noise is stored in the storing section in place of the previous amplitude spectrum of the noise;

a subtracting section that subtracts the estimated current amplitude spectrum of the noise from the current amplitude spectrum of the input sound signal to provide a current amplitude spectrum of the output sound signal;

a recombining section that recombines the current amplitude spectrum of the output sound signal and the current phase spectrum of the input sound signal to compose a current spectrum of the output sound signal; and an inverse-fourier-transforming section that inverse-fourier-transforms the composed current spectrum to produce the output sound signal which is at least partly free of the noise contained in the input sound signal.

14. The apparatus according to claim 13, wherein the storing section stores the current amplitude spectrum of the input sound signal for use in estimating of a next amplitude spectrum of the noise contained in the input sound signal observed from a next signal observation interval subsequent to the current signal observation interval.

* * * * *